United States Patent [19]

Natkins

[11] 4,082,336

[45] Apr. 4, 1978

[54] TAMPER PROOF SEAL

[75] Inventor: Ephraim Natkins, Jackson Heights, N.Y.

[73] Assignee: American Casting & Mfg. Corporation, Plainview, N.Y.

[21] Appl. No.: 742,053

[22] Filed: Nov. 10, 1976

[51] Int. Cl.[2] ..... B65D 33/34

[52] U.S. Cl. ..... 292/318

[58] Field of Search ..... 292/316, 318, 307, 319, 292/320, 321, 317

[56] References Cited

U.S. PATENT DOCUMENTS

| | | | |
|---|---|---|---|
| 3,146,012 | 8/1964 | King, Sr. | 292/320 |
| 3,708,835 | 1/1973 | Bienz | 292/307 R |
| 3,954,294 | 5/1976 | Iwamoto et al. | 292/318 |

*Primary Examiner*—Richard E. Moore

[57] ABSTRACT

A tamper proof seal comprising a tie member makes a seal with a coupling seal on a plug which is movable laterally into the seal body portion while said tie member is movable into said body portion perpendicularly to the movement of said plug, said tie member, said seal body portion and said plug capable of being molded out of a plastic material as a unit.

2 Claims, 8 Drawing Figures

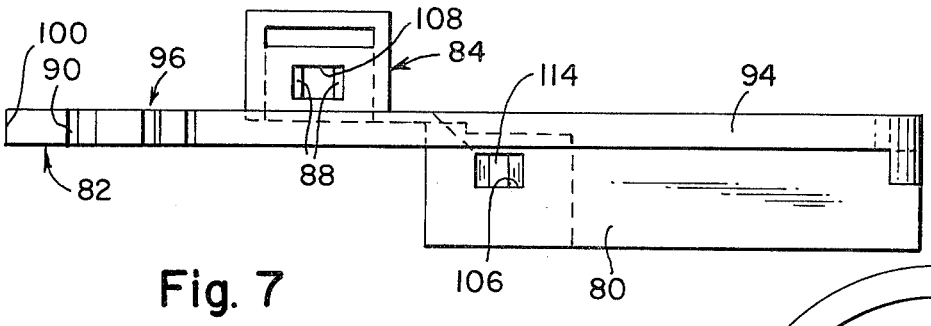
Fig. 7
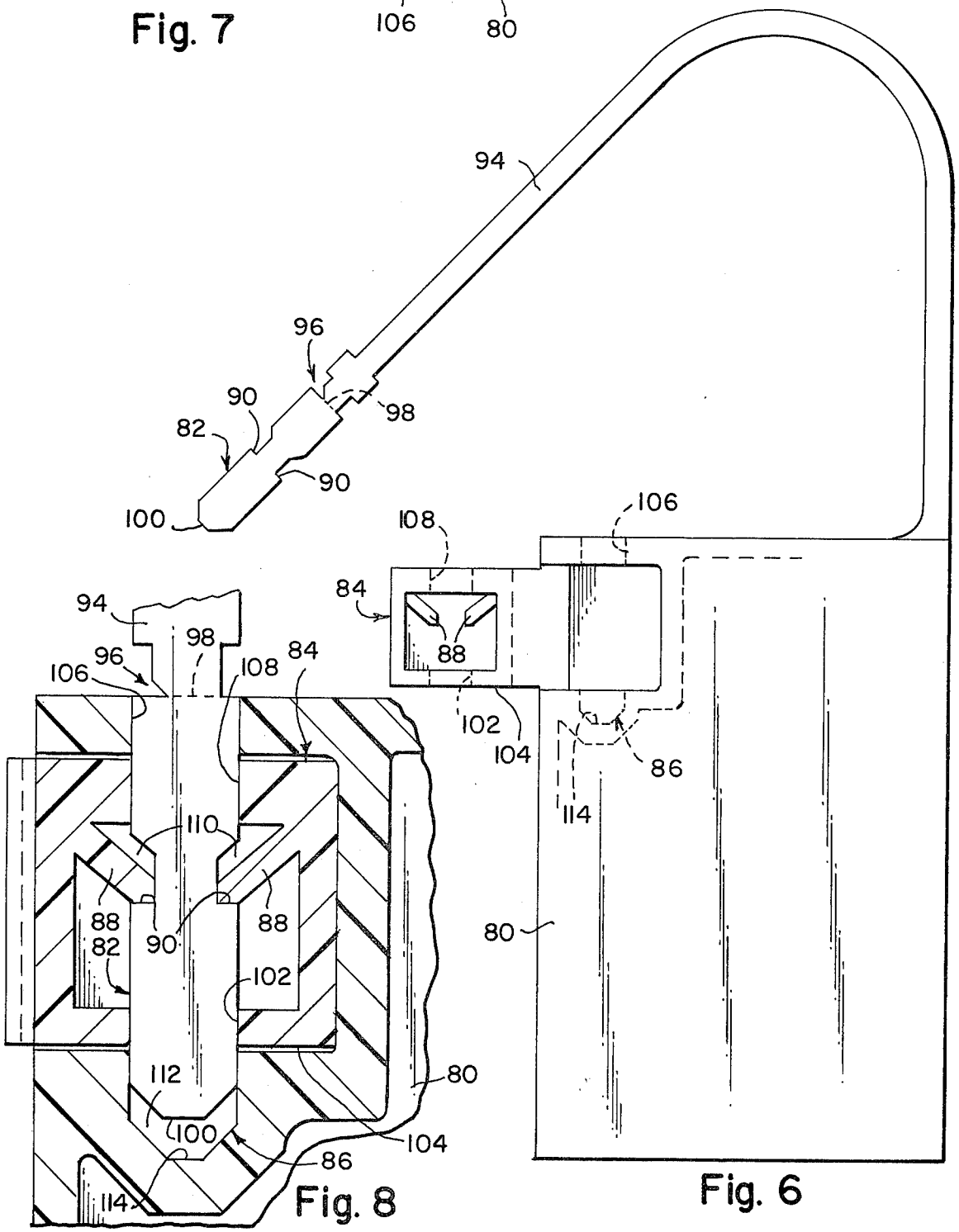
Fig. 8
Fig. 6

TAMPER PROOF SEAL

BACKGROUND OF THE INVENTION

This invention relates generally to seals, and is especially concerned with a tamper proof seal. A tamper proof seal is a seal which is used to secure closures over various items wherein the purpose of the seal is not so much to prevent unauthorized entry but to indicate that the item has been tampered with. The tamper proof seal is not strong enough to prevent the item from being opened. It is a seal which makes a permanent closure and which can be opened or unsealed only by destroying the seal itself.

There are two general requirements for such a seal. Since the seal is expendable and may be only used once there is a general requirement that it be inexpensive. The second general requirement is that the seal should be constructed in such a way that all of its parts are in close tolerance and that there are no openings through which a person can pry with a screw driver or other instrument to open the seal in a manner which would permit it to be resealed without destruction.

It is therefore an object of the present invention to provide such a seal which is self locking and which positively and automatically affects sealing action through its component parts and which cannot be opened or unlocked without destruction or defacement so as to clearly indicate at a glance the results of any tampering. It is another object of the invention to provide such a seal which may be economically mass produced, preferably of plastic material, to effectively reduce costs in removal and replacement of such tamper proof seals. Other objects of the present invention will become apparent upon reading the following specification and referring to the accompanying drawings.

BRIEF DESCRIPTION OF THE DRAWINGS

The invention is illustrated in the accompanying drawings in which:

FIG. 6 is a front elevation of another form of the invention with parts in phantom;

FIG. 7 is a top plan view of the form of the invention shown in FIG. 6 with parts in phantom; and FIG. 8 is a detail with parts in medial cross section of a portion of FIG. 6.

Similar numerals refer to similar parts throughout the several views.

DETAILED DESCRIPTION OF THE INVENTION

Figure 4:
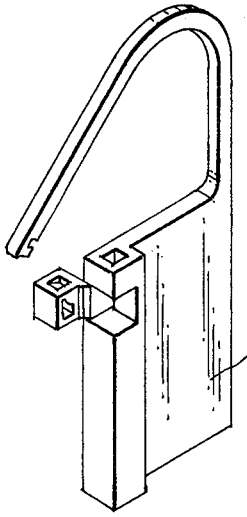
FIG. 4 shows another form of the invention in perspective.

The seal 10 illustrated in the drawings has a main body portion 12 and a second body portion 14. The main body portion 12 is provided with receiving means for the secondary body portion 14 and these receiving means are designated as a socket 16. The secondary body portion, which is preferably in the form of a plug 14, which fits snugly through a plug entry 15 in the main body portion into the socket 16. The plug 14 is designed to fit snugly within the socket 16 so that when it is in place it cannot be disturbed by tampering or meddling without destroying the seal of the seal 10. This is done by providing the plug 14 with outside walls which close the plug entry 15 when the plug is in position, and inside walls which are closed by facing inner walls of the socket when the plug 14 is in position.

Figure 1:
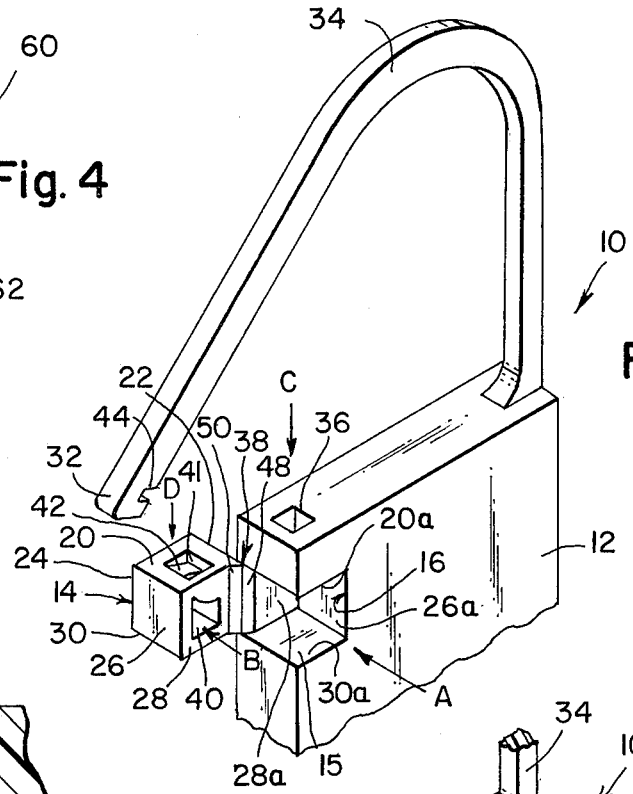
FIG. 1 is a perspective view showing the invention in unsealed condition.
Figure 3:
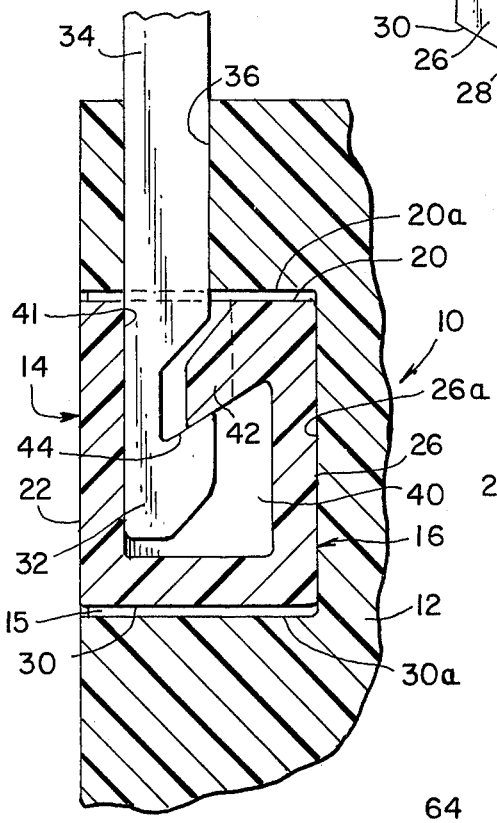
FIG. 3 is a greatly enlarged detail of FIG. 2 shown partially in section.
Figure 2:
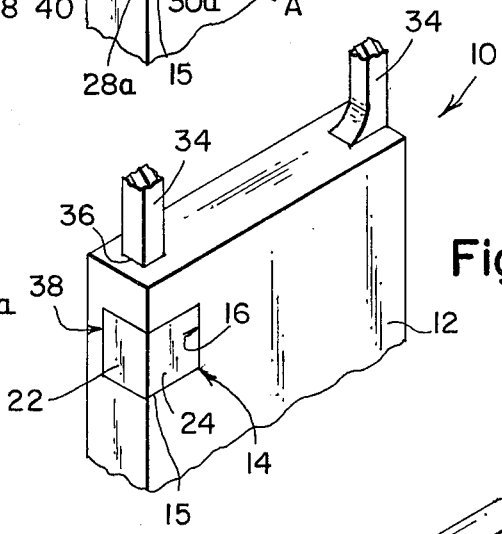
FIG. 2 is another perspective view of the invention shown in sealed condition.

Referring now to FIGS. 1 and 2 of the drawings, it can be seen that the plug 14 is provided with a top wall 20, side walls 22, 24, 26 and 28, and a bottom wall 30. The plug 14 is sized to fit in close tolerance so that its top 20 will fit in close facing relation to an upper wall **20*a* of the socket 16 and its bottom 30 in facing relation to a bottom wall 30*a* of the socket 16 when the plug 14 is in position within the socket 16. When in such position the side wall 22 will face outwardly as in FIG. 2. Side walls 26 and 28 will be within the socket in facing relation to socket walls 26*a* and 28*a***.

In order to make the seal 10 as tamper proof as possible, it is desirable to have as few openings as possible for the sealing mechanism. This is accomplished by having only one opening from the outer surface into the main body portion 12 for the engaging member 32 of the tying means 34. The engaging member 32 of tie member 34 fits into the opening of passageway 36 in body portion 16 so that it may engage the plug 14 when it is in position, as shown in FIG. 2, to couple with it to make the seal. The plug entry 15 is in offset relationship to the passageway 36.

In the preferred form of invention the secondary body portion or plug is hinged integrally to the main body portion 12 by hinge means 38. The plug may be rolled or rotated sideways into the socket to be engaged by the engaging member 32. This permits the entire seal 10 to be made of plastic in one molding operation as will be explained below.

The secondary body portion, or plug 14, has a chamber 40, an opening 41 matching the cross section of the passageway 36, and coupling means such as a flexible protuberance 42 which is engaged by the notch 44 of the engaging member 32 to make a coupling. The coupling makes a permanent seal in the sense that it cannot be opened without destroying the seal 10 itself.

The two body portions 12 and 14 can be molded as one piece with hinge 38 between them by providing mold form means including several cores. The first core would be placed in the mold in the direction of arrow A and have a configuration to form the socket 16 and part 48 of hinge 38. A second core in the direction of arrow B would have a configuration to form the lower half of chamber 40 below the protuberance 42 and part 50 of hinge 38.

A third core in the direction of arrow C would abut against core A to form passageway 36 into socket 16. A fourth core in the direction of arrow D would have a configuration to abut against core B and to form the protuberance 42 in the chamber 40. The balance of the mold, including the formation of the tying means 34 and its engaging member 32, could be made in any manner known to the art.

The principal advantage of this invention is the provision of a one piece single operation molded body portion which results in only one major opening 36 which becomes sealed by inserting the engaging member 32 of the member 34.

FIG. 4 shows another seal 60 which is identical in all respects to seal 10 except that it has a very thin taglike body portion 62.

Figure 5:
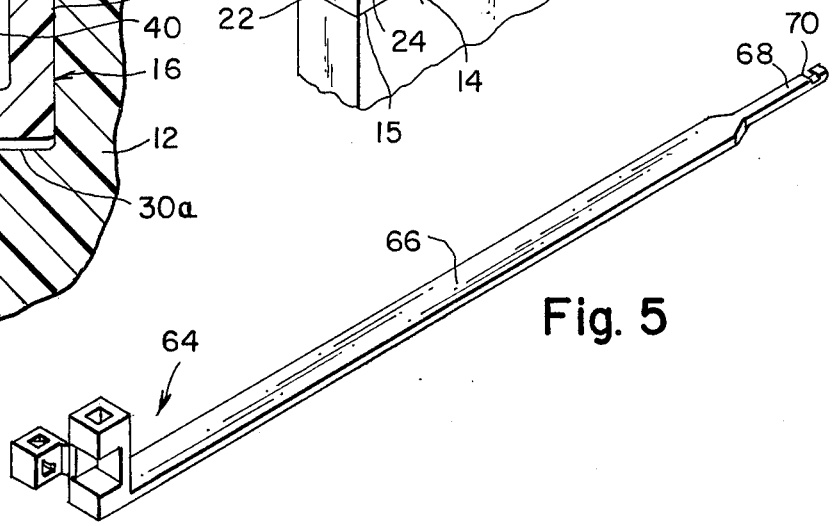
FIG. 5 is another form of the invention in perspective.

FIG. 5 shows another seal 64 which operates in the same manner as seal 10, but has a long strap tie member 66 instead of a filament tie member 34. The engaging means 68 has a notch 70 which is the equivalent of notch 44.

In FIGS. 6 through 8 another seal 80 is shown which operates in substantially the same manner as the seals of the invention described hereinabove. However, there are some modifications to the plug 84, the engaging member 82 and in the addition of a blind hole 86, as shown in FIGS. 6 and 8 of the drawings. The plug 84 is provided with a pair of protuberances 88 which cooperate with the notches 90 of the engaging member 82. Engaging member 82 is connected to tie member 94 by means of a weakened portion made by cutting into the material, as shown at reference numeral 96 in FIGS. 6 and 8, designed to cause engaging member 82 to break away from tie member 94 along dotted line 98 when a tampering pressure is placed on the device after the plug 84 and engaging member 82 are in locked position, as in FIG. 8. The engaging member 82 is of a relatively greater length between its end at line 98 and its leading end 100 than the depth of plug 84. This is so that leading end 100 will fit or pass through opening 102 in the bottom wall 104 of the plug 84 and into the blind hole 86, as shown in FIG. 8. This provides for an extra securing of the plug 84 into the body portion 80 at a part where engaging member 82 fits through the apertures 106 and 108 and at a second part where engaging member 82 fits through the aperture 102 and into the blind hole 86.

Spacing provision as shown at 110 and 112 in FIG. 8 permit engaging member 82 to ride up and down against the end 114 of blind hole 86 and the meeting point of protuberances 88 and shoulders 90. Thus some leaway is given when the plug engaging member 82 is placed through aperture 106 for the couple between notches 90 and protuberances 88 to be made. The seal is made by placing tie member 94 through the item to be protected in the usual manner and putting engaging member 82 into the plug 84 within the body portion 80, as shown in FIG. 8.

While the invention has been illustrated with a notch 44, or notches 90 and protuberance 42, or protuberances 88 to form the coupling, the coupling may have equivalent types of coupling elements such as spears, hooks, ratchets, or the like.

Wherefore, I claim:

1. A seal construction comprising a main body portion comprising socket means, a tie member comprising an engaging member comprising edges extending from said main body portion, a shaftway for the tie member in said body portion with an opening in said main body portion offset to said shaftway communicating with said socket means, said shaftway continuing through and beyond said socket means and ending as a blind opening, a second body portion in the form of a plug hinged to the main body portion at a first position outside of said main body portion socket means and movable to a second position within said socket means to fit said main body portion socket means through said offset opening, said second body portion plug comprising a pair of resilient protuberances in spaced facing relationship between which the engaging member is positionable, said hinged portion being along a surface of the main body portion and at least one wall of the second body portion plug to form at least a portion of at least one wall of the main body portion when said plug is in second position, said main body portion and said second body portion being formed from a material which has the property of being deformable at the hinged portion which connects said main body portion and said second body portion, said engaging member edges of said tie member and said protuberances of said plug being formed to cooperate to complete a coupling when said second body portion plug is fitted in said socket means and said tie member is positioned through said shaftway for said tie member, and said plug and said tie member being fitted with close tolerance.

2. The seal construction as claimed in claim 1, in which the tie member comprises a weakened portion adjacent said engaging member.

* * * * *